US005341739A

United States Patent [19]

Rogge et al.

[11] Patent Number: 5,341,739

[45] Date of Patent: Aug. 30, 1994

[54] APPARATUS FOR DISPLACING TWO BEARING BLOCKS MOUNTED ON CARRIAGES

[75] Inventors: Dieter Rogge, Lengerich; Dietmar Koopmann, Lienen-Kattenvenne, both of Fed. Rep. of Germany

[73] Assignee: Windmoller & Holscher, Lengerich, Fed. Rep. of Germany

[21] Appl. No.: 91,142

[22] Filed: Jul. 14, 1993

[30] Foreign Application Priority Data

Jul. 14, 1992 [DE] Fed. Rep. of Germany ... 9209455[U]

[51] Int. Cl.[5] ..... B41F 13/30; B41F 31/32; B41L 35/22

[52] U.S. Cl. ..... 101/247; 101/352

[58] Field of Search ..... 101/247, 351, 352, 218, 101/137, 139, 140, 143, 144, 145, 182, 184, 185, 192, 148

[56] References Cited

U.S. PATENT DOCUMENTS 5,125,339 6/1992 Rogge ..... 101/247

FOREIGN PATENT DOCUMENTS 0242061 12/1985 Japan ..... 101/352

*Primary Examiner*—J. Reed Fischer

*Attorney, Agent, or Firm*—Keck, Mahin & Cate

[57] ABSTRACT

An apparatus for displacing bearing blocks which are mounted on carriages and which support shafts to be displaceable on a common carriage guideway, preferably for the displacement of bearing blocks of plate cylinders and inking rollers of an inking unit in carriage guideways of the inking unit brackets of a multicolour rotary printing press, with two lead screw drives driven by two electric motors, preferably stepper motors. Each bearing block is provided with a nut into which there is respectively screwed one lead screw assigned to each of the bearing blocks. Each of the two lead screws is provided with one lead screw drive each, fixed to the frame at the end zones of the carriage guideway lying opposite each other.

6 Claims, 1 Drawing Sheet

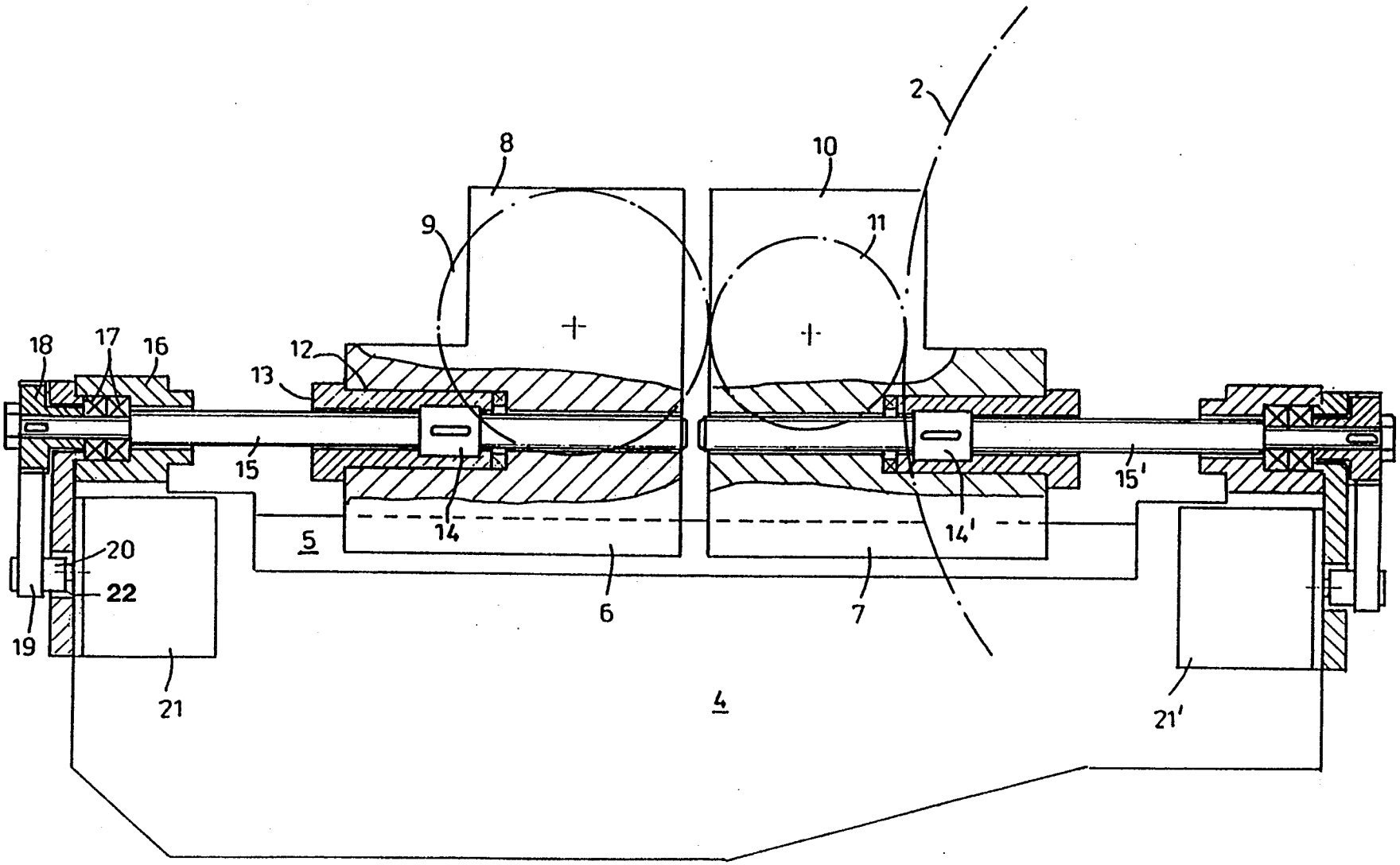
2
10
11
8
9
12
13
16
17
18
15'
14'
14
15
7
6
5
4
21'
21
20
22
19

APPARATUS FOR DISPLACING TWO BEARING BLOCKS MOUNTED ON CARRIAGES

The invention concerns an apparatus for displacing two bearing blocks which are mounted on carriages and support shafts for displacement on a common carriage guideway, preferably for the displacement of bearing blocks of plate cylinders and inking rollers of an inking unit in carriage guideways of the inking unit brackets of a multicolour rotary printing press, with two lead screw drives driven by two electric motors, preferably stepper motors.

PRIOR ART

In an apparatus of this kind known from the DE-OS 40 01 735, only one common spindle screw is assigned to both carriages on which are fitted two threaded nuts, one of which is joined to a carriage so as to be secured against rotation and displacement, and the other is mounted in the other carriage so as to be rotatable but secured against axial displacement and is provided with its own drive. This drive is arranged on the carriage and is displaceable therewith so that additional structural space is required above the inner end of the lead screw. However, this is not available, for example when the apparatus is used for the displacement of the bearing blocks of plate cylinders and inking rollers of a printing unit whose impression cylinder has only a smaller diameter since the electric motor, which has its mounting flange bolted on the inner carriages, could then collide with its bearing means.

OBJECT OF THE INVENTION

It is, therefore, the object of the invention to create an apparatus of the kind indicated at the outset, unencumbered by structural parts so that it is suitable, in particular for the displacement of the inner bearing block of a plate cylinder in an inking unit of a multicolour rotary printing press, when the impression cylinder only has a smaller diameter.

SUMMARY OF THE INVENTION

In accordance with the invention, this problem is solved in an apparatus of-the generic kind in that each bearing block is provided with a threaded nut into which there is screwed a lead screw assigned to each of the bearing blocks in such a way that each of the two lead screws is provided with one lead screw drive each, arranged fixed to the frame at the end zones of the carriage guideway lying opposite each other, and that at least the inner electric motor of the lead screw drive is fixed to the frame beneath the lead screw. Since, in the apparatus in accordance with the invention, the electric motor driving the inner lead screw is no longer arranged on the carriage and displaceable therewith, it can be fixed to the frame beneath the lead screw, so that for arranging the electric motor and a gear, no structural space above the lead screw is required. Thus the apparatus in accordance with the invention can be designed with more compact components, and in particular without any upwardly projecting structural parts, so that it is suitable in particular for driving the bearing block of a plate cylinder in a multicolour rotary printing press, if the press has an impression cylinder with a diameter smaller than normal.

Expediently, at least the electric motor of the inner lead screw drive is designed with a drive shaft pointing towards the driven end of the lead screw. This arrangement permits a particularly compact design because the electric motors serving for the drive can be arranged to be parallel to the lead screws beneath them.

Expediently, drive pinions are fitted at the ends of the lead screws remote from each other, and are driven via belt drives by the output gears of the electric motors or the stepper motors or by reduction gears driven by them.

According to a further advantageous design, provision is made for the bearing block of each side of the shaft or of the plate cylinder or inking rollers to be assigned their own lead screws so that, with an appropriate control of the screw drives, it is also possible to obtain possible slanting positions of the shafts or of the rollers or to compensate them.

A flexographic printing press of the kind known from the DE-OS 40 01 735 has a central impression cylinder 2 which is indicated by a dot and dash line and which has a diameter smaller than the impression cylinder shown in the DE-OS 40 01 735, to which there are assigned in all eight inking units and plate cylinders which are displaceable on the brackets of inking units.

BRIEF DESCRIPTION OF THE DRAWINGS

These and other objects and advantages of the present invention will become clearer from a reading of the following description of an example of an embodiment of the invention explained with reference to the accompanying drawing, in which the single Figure is a side view, partly in section, of the bearing blocks carried in a carriage guideway, for a plate cylinder and for an inking roller of a multicolour rotary printing press.

DETAILED DESCRIPTION OF THE PREFERRED EMBODIMENT

The accompanying drawing shows an inking unit bracket 4 which is secured on a printing press stand in a known way. The inking unit bracket 4 is provided with a straight carriage guideway 5 on which are displaceably carried two carriages 6, 7. Rigidly connected to the carriage 6 is a bearing block 8 in which there is mounted a journal pin of the inking roller 9. A bearing block 10 connected to the carriage 7 has the journal pin of the plate cylinder 11 mounted therein.

The block of the carriage 6 is provided with a recessed bore 12, in which there is rigidly arranged a bush 13 which has a hollow cylindrical bore in which is fixed a threaded nut 14 secured against rotation and against displacement in the axial direction. For retaining the nut 14 of the bush 13, it is provided with an adjusting spring and a screwed-on retaining ring securing the screw nut. A lead screw 15 is screwed into the nut 14. At its outer end, the lead screw 15 is mounted by means of roller bearings 17 in the bearing block 16 fixed to the frame. A gear wheel 18, keyed onto the driven end of the lead screw 15 projecting beyond the bearing block 16, is connected via a toothed belt 19 to a pinion 20 that is fitted on the output shaft 22 of a stepper motor 21 which is rigidly connected to the bracket 4 or is bolted thereon by means of a mounting flange.

As shown in the drawing, the carriage 7 of the bearing block 10 for the plate cylinder 11 is provided in a corresponding mirror-inverted arrangement with a lead screw drive that is designed in the same way are the lead screw drive for the carriage 6 of the inking roller, so that reference may be made to their description.

We claim:

1. Apparatus comprising two bearing blocks which are each mounted on respective carriages on a frame, the two carriages being displaceable on a common carriage guideway, and having two respective lead screw drives driven respectively by two electric motors; the improvement wherein each bearing block is provided with a respective nut and a respective lead screw engaged with each of the bearing blocks, said respective lead screw being screwed into said respective nut; wherein each of the two lead screws is provided with a respective one of said lead screw drives fixed to the frame at a respective end zone of the carriage guideway; and wherein the electric motor of each lead screw drive is fixed to the frame beneath the respective lead screw.

2. An apparatus according to claim 1, wherein the electric motor of each lead screw drive is installed with a driven end of the lead screw pointing in the same direction as an output shaft of the motor.

3. An apparatus according to claim 1, wherein the lead screws have drive pinions fitted at ends of the lead screws which are remote from each other, said pinions being driven, via belt drives, by gears of the electric motors.

4. An apparatus according to claim 1, wherein the two bearing blocks support a plate cylinder and an inking roller, respectively, and the respective lead screws are engaged with the respective bearing blocks of the plate cylinder and the inking roller.

5. An apparatus according to claim 1 wherein the electric motors are stepper motors.

6. An apparatus according to claim 1, wherein the bearing blocks displaceably support plate cylinders and inking rollers of an inking unit in carriage guideways of inking unit brackets of a multicolour rotary printing press.

* * * * *